United States Patent [19]

Winger, Jr.

[11] Patent Number: 4,750,300

[45] Date of Patent: Jun. 14, 1988

[54] GUTTER SCREEN GUARD

[75] Inventor: William C. Winger, Jr., Lancaster, Pa.

[73] Assignee: Novelty Manufacturing Company, Lancaster, Pa.

[21] Appl. No.: 11,000

[22] Filed: Feb. 5, 1987

[51] Int. Cl.[4] ..... E04D 13/00

[52] U.S. Cl. ..... 52/12; 248/48.1; 210/474

[58] Field of Search ..... 52/11, 12; 248/48.1; 210/474; 24/336, 457, 458

[56] References Cited

U.S. PATENT DOCUMENTS

| | | | |
|---|---|---|---|
| 870,165 | 11/1907 | Hagler | 52/12 |
| 1,526,821 | 2/1925 | Andrews | 52/12 |
| 2,209,741 | 7/1940 | Sullivan et al. | 210/474 |
| 2,271,472 | 1/1942 | Balduf | 52/241 |
| 2,365,845 | 12/1944 | Schweda | 52/12 |
| 2,542,155 | 2/1951 | Moller | 52/12 |
| 2,636,458 | 4/1953 | Harris | 52/12 |
| 2,664,899 | 1/1954 | Attias | 24/336 |
| 2,734,467 | 2/1956 | Steele | 52/12 |
| 2,948,083 | 8/1960 | Steele | 52/12 |
| 3,297,285 | 1/1967 | Simmons | 248/48.1 |
| 3,351,206 | 11/1967 | Wennerstrom | 52/12 |
| 3,371,900 | 5/1968 | Jacobs | 24/336 |
| 3,630,383 | 12/1971 | Reeves | 210/474 |
| 3,834,091 | 9/1974 | Dugan | 52/12 |
| 4,036,761 | 7/1977 | Rankin | 52/12 |
| 4,307,976 | 12/1981 | Butler | 52/11 |

*Primary Examiner*—James L. Ridgill, Jr.
*Attorney, Agent, or Firm*—Martin Fruitman

[57] ABSTRACT

A screen guard for covering eaves troughs on buildings. A screen which is framed with smooth rounded edging is laid atop the roof above the gutter edge and held tightly in place with a clip specifically shaped to grip the outermost gutter lip, support the framed screen and press the screen downward onto the roof. A small extension of the clip inward toward the roof permits the clip to support the screen during installation, and to guide it as it is locked into place.

10 Claims, 1 Drawing Sheet

GUTTER SCREEN GUARD

SUMMARY OF THE INVENTION

This invention deals generally with static structures and buildings and more specifically with a cover for roof eaves troughs with a screen separator to prevent debris from entering the eaves troughs.

Roof eaves troughs, or gutters, are notorious for filling with leaves and other debris, and cleaning those gutters is a difficult, tedious, and sometimes dangerous task. This has resulted in numerous products and patents for devices which protect the gutters from debris while permitting water to flow into them. Most of these devices include screening covering the gutters, but since they usually do not prevent all debris from entering the gutters, they must still provide for occasional access to the gutter for some cleaning.

These design criteria have led to a variety of screen guard designs which include the whole range from raw edged screening slipped under the roofing material to complex hinge and spring designs. However, in looking over this selection one begins to suspect that the designers never themselves climbed a ladder with their product and attempted to install it while perched precariously twenty or thirty feet above the ground.

The big problems in installing gutter guards are that the ladder usually must rest on the gutter itself, and therefore may interfere with installation, and that most gutters are far from linear once they are installed. The typical gutter edge is actually a wavy line with curves in both the vertical and horizontal planes. Moreover, it is common to find localized distortions such as pinches of the edges or lips of the gutters. Once this "real world" situation is recognized, it can be better appreciated that installing gutter guards is not as easy as the salesmen would have you believe. In fact, it is virtually impossible to install a unit which requires continuous attachment to the edge of the gutter.

However, other problems also occur, mostly because the installer usually must work on only one small region of the gutter at a time, on that portion which can be reached from one ladder position. Thus, any system which requires multiple point alignment becomes very difficult to install.

The present invention attacks these problems with the goal of furnishing a gutter shield which not only functions to keep debris from entering the gutter, but also is simple to install or remove by one person working from one location at a time, and also accommodates to variations in the height of the gutter and distortions in its edge.

This is accomplished by using relatively short, approximately three foot long sections of framed screening and attaching that screening with spaced individual clips which not only provide downward pressure on the screen, but also provide for temporarily supporting the screen in its approximate location while it is being installed, but before it is locked in place.

The screens of the preferred embodiment of the invention are large mesh screens framed with smooth edging on the long edges. The screen width is sufficient to cover most conventional gutters, and while attached to the outermost edge of the gutters the screens extend to and overlap the roof edge. The screen can be made in any convenient lengths, but lengths of approximately three feet are convenient to carry up a ladder and to manipulate while high on a ladder. Each section of screen is framed on the long edges with solid edging which is actually a small strip folded over in its narrow dimension to form a smooth rounded edge. The edging is fitted over the screen edge and pinched tightly to be self clamping.

Screen sections can therefore be handled easily and casually, both because of their convenient size and because the rough screen edges on the long sides are completely covered with edging. The edging also performs another vital function in that it stiffens the screen section so that it lies flat on the roof and on the gutter edge to which it is attached. The edging therefore permits the screen sections to be attached to the gutter edge with individual isolated clips located at a relatively few points and eliminates the need for precise alignment of the screen with the gutter edge.

The attachment clip of the present invention serves not only to hold the screen sections onto the outside edge of the gutter, but also to put downward pressure on the screen to hold the screen's other edge tightly against the roof. More important, the clip is specifically designed to permit the screen section to be rested upon it temporarily before the screen is locked into place and to guide the screen into the clip during installation without any particular effort on the part of the installer.

The clips accomplish these functions because of their special construction. Each clip is constructed of a short length of spring material which is folded into an approximate "S" cross section shape. The clip of the present invention goes beyond a simple "S" clip, however, in that it is specifically designed to guide the framed screen into itself, so that installation requires neither skill, patience nor excessive time. Installation of the system is, in fact, virtually instantaneous, and this is also true for disengagement and reinstallation during later cleaning of the gutters.

The special feature of the design of the clip is surprisingly simple. The essential requirement is that the widths of the top and middle segments of the "S" cross section are different in size. That is, looking at the edge of the clip, the uppermost segment, the top of the upper loop which folds back toward the roof of the building, and is transverse to the folds of the clip, is smaller than the middle segment of the "S". That is, the upper segment does not extend to the far side of the middle segment.

This difference in width of the top and middle segments is what gives the clip its self guiding property when the framed screen is inserted into the clip. The screen edge being inserted is placed on the protruding middle segment of the clip and a slight motion pushes the screen into the clip. This action is aided by a small flare formed into each open edge of the clip, so that the screen edge will be led into the clip. The clip is also constructed so that neither the edge of the screen nor the lip of the gutter will inadvertently slip out of place once installed.

However, the clip is further constructed so that the removal of the screen from the clip for purposes of cleaning the gutters may be easily accomplished by applying a reasonable amount of separating force.

Furthermore, the clip is constructed so that the system of clip and screen will adapt to a range of height differentials between the roof edge and the gutter.

The combination of the framed screen section and isolated self guiding clips of the present invention provides an eave trough screen guard which any installer can use without problems. All that is required is to push the clip against the gutter lip and then, while resting the screen on the installed clip, to push the screen into the top loop of the clip. The spring action of the clip then holds the framed screen tightly against the roof atop the roofing material.

DETAILED DESCRIPTION OF THE INVENTION

Figure 1:
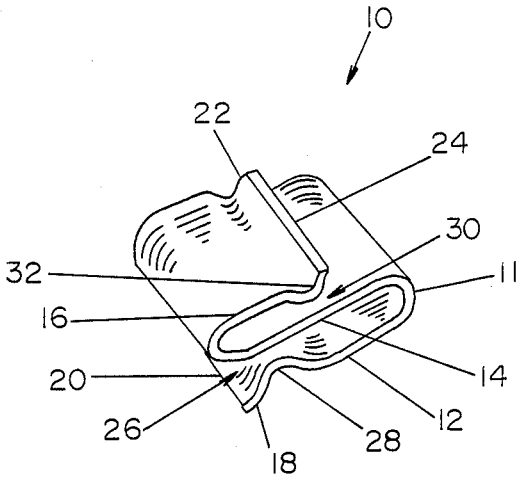
FIG. 1 is a perspective view of the spring clip of the invention.

FIG. 1 is a perspective view of the preferred embodiment of spring clip 10 of the invention in which middle segment 14 is longer than upper segment 16. The major features of spring clip 10 are most apparent by viewing the shape of an edge of clip 10.

There it can be seen that clip 10 is formed essentially as a flattened "S" configuration with upper segment 16 shorter than middle segment 14. The difference in dimensions is what gives clip 10 its self guiding feature.

Lower segment 12 has flare 18 shaped into end 20 and flare 22 is shaped into end 24 of shorter segment 16 in order to make insertion of mating parts easier by providing a wedge shaped entry area.

Clamp 26 is formed between segment 12 and middle segment 14 by forming raised dimple 28 in segment 12 to reduce the clearance between segment 12 and segment 14 and thus tightly pinch the mating part which is inserted during use.

Similarly, clamp 30 is formed between shorter segment 16 and middle segment 14 by forming dimple 32 to reduce the clearance between dimple 32 on segment 16 and the surface of segment 14.

Bend 11 of clip 10 is constructed to provide generous clearance between segments 12 and 14 around the gutter edge, so that clip 10 can tilt slightly, and thereby provide accommodation of the screen to various roof heights.

Figure 2:
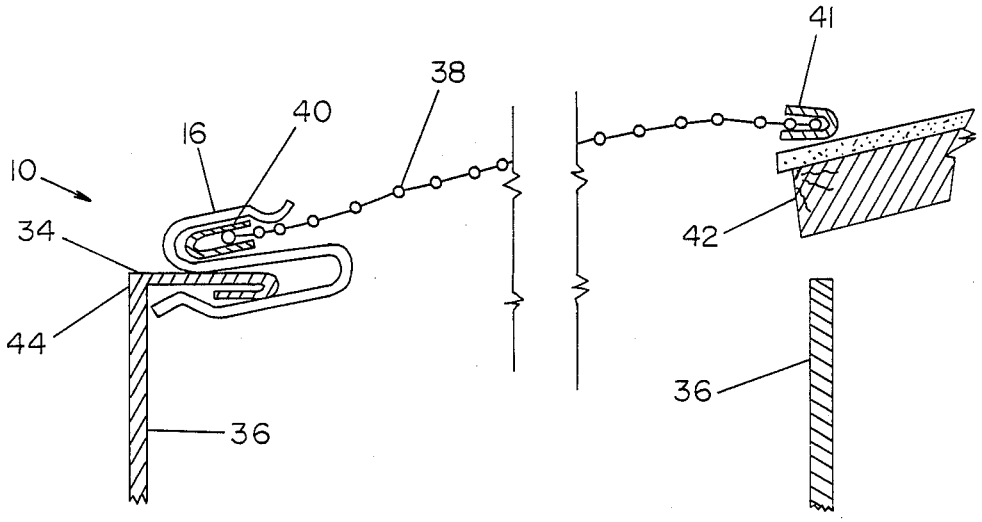
FIG. 2 is a partial cross section view of the framed screen inserted into the expanded spring clip mounted on an eave trough.

FIG. 2 is a partial cross section of the preferred embodiment of the invention as used in a typical eaves trough installation in which spring clip 10 is mounted on lip 34 of eaves trough 36. Screen 38, the edges of which are completely enclosed by smooth edged framing 40 and 41, is inserted into clamp 30 and held with downward pressure against roof 42 by smaller segment 16 of clip 10. Clamp 26 holds clip 10 in place on lip 34 of eaves trough 36.

The advantages of the present invention can best be appreciated with reference to FIG. 2.

It can first be noted that corner 44 of eaves trough 36 is the outermost edge of the eaves trough against which a ladder (not shown) would normally be rested. Corner 44 is, however, completely clear of the installation of both clip 10 and screen 38, so that the ladder placement will not in any manner interfere with installation of the parts of this system.

Furthermore the installation of the clips and screen is very simple and requires no tools. The installer need only take a single section of framed screen and several clips up the ladder. FIG. 2 is not drawn to scale, so it should be appreciated that with a typical clip being only approximately three-quarter inch long in the direction parallel to the gutter, one inch wide and one-half inch high, a pocket full of clips would be no inconvenience to carry.

To install the screen the installer need only reach comfortably to each side of the ladder and install three clips onto the outer lip of the eaves trough. This is done quite simply by holding flare 18 of lower segment 12 against the under surface of eaves trough lip 34 and pushing clip 10 onto lip 34 by pressing on the rounded edge formed by the junction of segments 12 and 14 of clip 10. Regardless of the position of the ladder the clips can not be interfered with, because clip 10 will stop before it does interfere.

With two or more clips installed on the eaves trough, the installer need only grasp far edge 41 of framed screen 38, rest near edge 40 of screen 38 on the exposed top surface of middle segment 14 of clip 10, and move the screen toward corner 44 of eaves trough 36. The motion is a perfectly safe one, since the reaction force pulls the installer toward the roof, not backwards, and the force of pushing screen edge 40 between middle segment 14 and upper segment 16 also assures that clip 10 is firmly attached to lip 34 of the eaves trough.

Once installed, the spring force of segment 16 downward on edge 40 of screen 38 assures that edge 41 will be held tightly against roof 42. Moreover, the structure of screen 38 with the stiffening action of framing and its slight bow in the screen, assures that it will also lie flat in its length dimension, along the length of the eaves trough, even though it is attached only at widely separated points.

The invention therefore furnishes a simply installed system to prevent debris from entering the gutters, and the screen can also be easily removed for later cleaning of the gutters.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For instance, clamps 26 and 30 could be constructed differently, such as by the distortion which reduces the clearance being formed in middle segment 14 rather than in segments 12 or 16. Moreover the clamps could be formed by other means such as thickening the material in a limited region.

What is claimed as new and for which Letters Patent of the United States are desired to be secured is:

1. An apparatus for keeping debris out of building gutters comprising:

independent clip means, detached from any screen, comprising a length of material folded into the shape, in cross section, of three approximately parallel segments, a first segment being the middle segment located between a second and third segments, and the third segment being shorter than the middle segment in the direction transverse to the folds, the clip means being attachable to a lip of a building gutter by inserting the gutter lip between the middle segment and the second segment of the clip means; and screen means, comprising essentially planar material with multiple holes through which liquid can flow, further including framing means upon at least two longest edges, the framing means comprising solid material with smooth edges, the screen framing means being insertable between the middle segment and the third segment of the clip means.

2. The apparatus of claim 1 wherein the clip means further includes a clamp means which reduces the clearance between the first segment and an adjacent segment in a localized area of the space between them.

3. The apparatus of claim 1 wherein the clip means further includes a flare on the end of a segment other than the first segment, the flare curving away from the first segment.

4. The apparatus of claim 1 wherein the clip means is constructed of sheet spring material.

5. The apparatus of claim 1 wherein the separation between the first and second segments of the clip means is sufficient to permit the clip means to tilt upon a mating part which is inserted between the first and second segments.

6. An independent clip separate from any screen for holding a gutter screen onto the lip of a gutter comprising a length of material folded into the shape, in cross section, of three approximately parallel segments, the first segment being the middle segment located between a second and third segment and the third segment being shorter than the middle segment in the direction transverse to the folds, the clip means being attachable to a lip of a building gutter by inserting the gutter lip between the middle segment and the second segment of the clip.

7. The clip of claim 6 wherein the clip further includes a clamp means which reduces the clearance between the first segment and an adjacent segment in a localized area of the space between them.

8. The clip of claim 6 wherein the clip further includes a flare on the end of a segment other than the first segment, the flare curving away from the first segment.

9. The clip of claim 6 wherein the clip is constructed of sheet spring material.

10. The clip of claim 6 wherein the separation between the first and second segments of the clip is sufficient to permit the clip to tilt upon a mating part which is inserted between the first and second segments.

* * * * *